United States Patent [19]

Kornrumpf et al.

[11] Patent Number: 4,819,126

[45] Date of Patent: Apr. 4, 1989

[54] PIEZOELECTIC RELAY MODULE TO BE UTILIZED IN AN APPLIANCE OR THE LIKE

[75] Inventors: William P. Kornrumpf, Albany; John D. Harnden, Jr., Schenectady, both of N.Y.

[73] Assignee: Pacific Bell, San Francisco, Calif.

[21] Appl. No.: 195,949

[22] Filed: May 19, 1988

[51] Int. Cl.[4] ..... H01H 47/26; H01H 50/12; H01H 59/00

[52] U.S. Cl. ..... 361/207; 361/211; 310/332; 200/181

[58] Field of Search ..... 361/207, 211; 200/181; 310/332

[56] References Cited

U.S. PATENT DOCUMENTS 4,654,555 3/1987 Ohba et al. ..... 310/332
4,697,118 9/1987 Harnden, Jr. et al. ..... 200/181

FOREIGN PATENT DOCUMENTS 0060005 5/1977 Japan ..... 310/332

*Primary Examiner*—L. T. Hix
*Assistant Examiner*—David Porterfield
*Attorney, Agent, or Firm*—Fitch, Even, Tabin & Flannery

[57] ABSTRACT

A piezoelectric relay module having a plurality of relays of different load ratings is disclosed. Each relay is constructed from a portion of a single bimorph structure by cutting the bimorph structure to form bimorph actuators. The widths of the various bimorph actuators is varied to provide the different load ratings.

10 Claims, 4 Drawing Sheets

PIEZOELECTIC RELAY MODULE TO BE UTILIZED IN AN APPLIANCE OR THE LIKE

FIELD OF THE INVENTION

The present invention relates to piezoelectric relays and more particularly to relays in which the contacts are actuated by a motion of a bimorph constructed from piezoelectric materials.

BACKGROUND OF THE INVENTION

Relays are utilized for a variety of applications. In most appliances, several different types of relays (switches) are necessary to insure that the variety of switching circuitry in the appliance operates properly. For example, in a dishwasher, the heater and motor loads require a switch rated at 3–7 amperes, while the detergent and rinse load actuator requires a switch rated at less than 1 ampere of load current. Similarly, in a refrigerator, the compressor may present a 12 ampere load, the defrost heater may present a 5 ampere resistive load, the ice maker motor and heater load may draw 1–2 amperes, and the ice dispenser motor may draw less than 1 ampere of load current.

In conventional appliances, each of the loads or switches would require a separate electromechanical or solid state relay device. Accordingly, in such an appliance, a variety of different relays would be required.

Since these relays are bulky components, they are not easily inserted in the control board of the appliance by automated machinery, leading to higher assembly costs. The use of a variety of relay types also reduces the number of any individual type of relay used in the appliance, and thus increases the unit cost and the inventory necessary at the factory and at various service locations. Each of the individual relays further requires a protective cap or cover, which increeases the overall appliance cost.

There are many types of relays that can be utilized in an appliance for the various switching functions located therein. In the past, the relays have been either electromechanical or solid state devices. Electromechanical devices present many disadvantages including large size and weight, high power consumption, and lack of reliability. When used in an appliance such as a refrigerator or a washing machine, the sheer size and complexity of the appliance greatly exaggerates these disadvantages.

Solid state devices, while much smaller in size and requiring less power than electomechanical relays, present the disadvantages of fragility in most types of real-world operating conditions. This fragility gives a relay system implemented with solid state devices a potentially high failure rate, making them difficult and expensive to maintain.

It is known in the art to use piezoelectric relays. Relays of this type are particularly well suited to use in appliances or the like. In general, the physical size of a piezoelectric relay is much smaller than the size of an equivalent electromechanical relay. It is known that a number of individual relays can be constructed from a common piezoelectric bimorph structure. A detailed description of known bimorph structures follows.

A bimorph structure typically consists of two elongated strips of piezoelectric material bonded to a center conducting strip. The outer surfaces of the two elongated strips, which are isolated from the center conductor, are covered with a conducting material to form outer electrodes. Each of the elongated strips is polarized such that the application of an electric field across the narrow dimension of the strip results in a change in the length of the strip. In previous relays which employ this type of actuator, the electric field is appied to the two strips in the bimorph structure such that one of the two strips is shortened while the other of the two strips is lengthened.

The application of these electronic fields results in a deflection of the bimorph in a direction perpendicular to the axis of the elongated strips. This deflection is typically utilized to make or break an electrical circuit by causing one contact on the bimorph to touch or move away from a second contact.

In previously known piezoelectric relays, the relays are made by cutting gaps in a bimorph element such that each outer electrode of each finger is isolated from the corresponding outer electrode of the neighboring finger. Each of the fingers is similarly driven by circuitry contained in a chip or other integrated circuit device. However, in previously known piezoelectric relay modules, each relay has the same load rating. Thus, previous piezoelectric relay modules have not been utilized for providing relays capable of handling a variety of electrical loads.

Accordingly, what is needed is a relay module that can be utilized in an appliance or the like to handle the different rated loads therein. What is also needed is a relay module that is easily adaptable to different load configurations. Finally, what is needed is a module that can be customized for a particular load configuration.

Broadly, it is an object of the present invention to provide a piezoelectric relay that can control multiple loads within a single device.

It is another object of the present invention to provide a piezoelectric relay that is less costly than previously known relays to control such devices.

It is a further object of the present invention to provide a piezoelectric relay that permits multiple load control in which all of the different loads can be controlled in a single modular design, thereby reducing the overall cost of the relay.

SUMMARY OF THE INVENTION

The present invention is a piezoelectric relay moduel for use in an appliance or the like, that has multiple relays, each relay being capable of controlling a load of a different size.

The relay module contains a bimorph element comprising substantially overlying first and second planar sheets of piezoelectic material divided into a plurality of generally coplanar fingers that extend from a common spine. In this module, at least one of the plurality of coplanar fingers has a width which is different from that of the other coplanar fingers.

In this embodiment each of the fingers has a fixed end connected to the common spine, and a free end that includes an electrical contact. The relay module includes a support element to support the bimorph. This support element includes a plurality of contacts. The contacts of the support element engage corresponding contacts on the bimorph element when an electric field is applied to the corresponding finger.

Accordingly, what is provided is an improved piezoelectric relay module that can be utilized in an appliance or the like. By varying the widths of the coplanar fingers to correspond with the load to be controlled, loads of different sizes can be controlled within one relay module.

In addition, since the relay module is a unitary structure, there is a significant reduction in overall assembly cost. Finally, because of the unitary construction, a number of individual relays that normally are used in an appliance or the like can be consolidated into a single modular design, thereby further reducing the overall cost of the appliance.

BRIEF DESCRIPTION OF THE DRAWINGS

The advantages of the present invention will become apparent from the following detailed description in conjunction with the drawings in which.

DETAILED DESCRIPTION OF THE DRAWINGS

Figure 1:
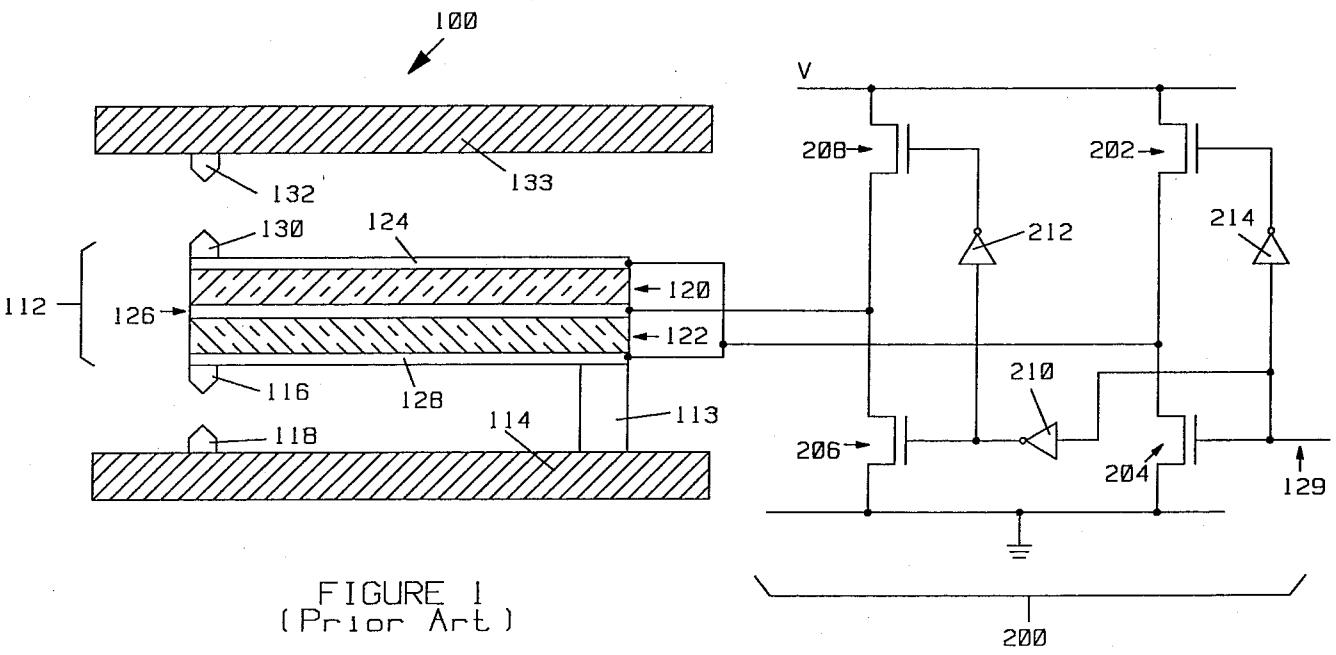
FIGURE 1 (Prior Art)
FIG. 1 is a cross-sectional view of a typical prior art piezoelectric with its associated drawing circuit.

Bimorph elements are utilized in a variety of applications. For example, it is known that bimorph elements can be utilized advantageously as switches in telecommunications.

Bimorph elements have the primary advantage of being less bulky than electromechanical relays while being more reliable than solid state devices. This advantage becomes more important when a plurality of relays are required in one device.

As noted above many types of equipment require a variety of relays to control the various loads associated therewith. For example, an automobile requires an individual relay for each of the different electrical functions in the automobile. Hence, there are relays associated with the lights, radio, windshield wipers, air conditioner, etc. Similarly, in different types of appliances, such as a refrigerator, washing machine or the like, there are relays associated with various functions. All of these are excellent candidates for the use of bimorph elements.

Bimorph elements have been traditionally utilized in modules that have a plurality of relays. Typically, all of the relays in a module have the same load rating. It is known that the load rating of a piezoelectric relay is directly dependent upon the dimensions of the relay. To understand this feature of a bimorph element more clearly refer to the following description of a typical piezoelectric relay 100 shown in FIG. 1.

The piezoelectic relay 100 consists of a piezoelectric bimorph 112 which is mounted in a cantilever manner over a surface 114. The free end of bimorph 112 includes a first electrical contact 116 which is brought into contact with a second electrical contact 118 when the free bimorph end on which electrical contact 16 is mounted moves toward surface 114.

Bimorph 112 typically consists of two planar strips of piezoelectric material, shown at 120 and 122 that are bonded to three planar electrodes, 124, 126, and 128. Electrical contacts 116 and 130 are electrically isolated from electrodes 128 and 124, respectively. Each of the strips of piezoelectric material 120 and 122 is polarized such that the application of an electrical field across the strip will result in a change in length of the strip. The direction of the electrical field relative to the direction of polarization determines whether the length of the strip will increase or decrease. The polarization of strip 120 is opposite to that of strip 122.

The electric field is generated by the application of an electrical potential between electrodes 124 and 126 simultaneous with the application of the opposite potential between electrodes 126 and 128. This potential pattern causes one of the strips to shorten and the other to elongate. As a result, the bimorph will either bend toward surface 114 or away from said surface depending on the direction the electrical fields generated. One direction is used to close the relay contacts, the other is used to move the contacts away from each other. In principle, this second motion can be used to cause a second set of contacts 130 and 132 to close, thus implementing a single-pole double-throw relay.

A driving circuit 200 for operating relay 100 in this manner is also shown in FIG. 1. The circuit 200 has two states, which are specified by the signal level on control line 129. In the first state, a first potential, V is applied to electrodes 126, and a second potential, ground, is applied to electrode 124 and 128. In the second state, the first potential is applied to electrode 124 and 128, and the second potential is applied to electrode 126.

The circuitry operates in the following manner. For the purposes of explanation, assume that, in FIG. 1, all transistors are MOS enhancement mode field effect transistors, and also assume that when the transistors are "on" they exhibit a low impedance and when they are "off" they exhibit a high impedance.

Referring to FIG. 1, the input of an inverter 214 is connected through control line 129 to the gate of a transistor 204 and to the input of an inverter 210. The output of inverter 214 is coupled to the gate of transistor 202. The output of inverter 210 is coupled to the gate of a transistor 206 to and the input of an inverter 212. The output of inverter 212 is connected to the gate of a transistor 208. The drains of transistors 202 and 208 are connected to voltage source V. The sources of transistors 204 and 206 are connected to ground. The drain of transistor 206 and the souce of transistor 208 are connected to each other, and, in addition, are coupled to the center electrode 126. The source of transistor 202 and the drain of transistor 204 are connected to each other, and, in addition, are coupled to the top and bottom electrodes 124 and 128.

When an input signal higher than the threshold voltage of the transistors is provided to the inverters 210 and 214, transistors 204 and 208 will be on and transistors 206 and 202 will be off. Through this action, a potential of ground is applied to the top and bottom electrodes 124 and 128 and a potential of V is applied to center electrode 126, thereby causing the bimorph 112 to bend downward.

When a signal below the threshold voltage of the transistors is provided to the inverters 210 and 214, the transistors 204 and 208 will be turned off and transistors 202 and 206 will be turned on. Through this action, ground is applied to the center electrode 126, and the top and bottom electrodes 124 and 128 are connected to a potential of V, causing the bimorph 112 to bend upward.

The force applied by the end of the bimorph depends on the displacement of the bimorph arm from its resting position, i.e., the position in which no potentials is applied to electrodes 124, 126, and 128, the length of the bimorph arm, and width of the bimorph arm. For any given applied voltage between the center electrode 126 and the outer electrodes 124 and 128, there is a maximum force, F, and a maximum displacement, D, that may be obtained from the bimorph.

For a bimorph having a length, L, and a width, w, it may be shown that the maximum displacment, D, is approximately proportional to $L^2$, and that the maximum force, F, that the bimorph can provide is approximately proportional to w/L. That is, $$D=kL^2, \text{ and} \quad (1)$$

$$F=k'w/L, \quad (2)$$

where k and k' are constants that depend on the piezoelectric material used to construct the bimorph and the mechanical properties of the bimorph.

Thus, for a given thickness, the force or load rating of the piezoelectric relay is directly proportional to the width of the bimorph and inversely proportional to the length thereof.

Modules comprising a plurality of these types of piezoelectric relays are known. For example, U.S. Pat. No. 4,697,118, entitled "Piezo-Electric Switch", and assigned to the General Electric Corporation, is a relay module that has a plurality of relays of the type shown in FIG. 1.

Figure 2:
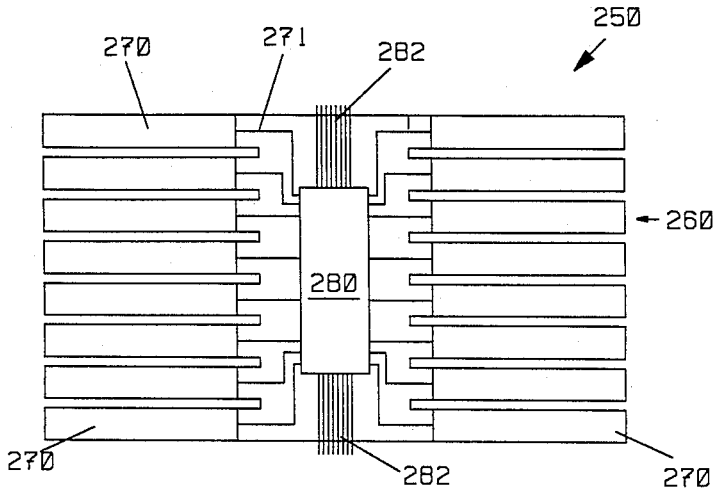
FIGURE 2 (PRIOR ART)
FIG. 2 is a top view of a prior art relay module.
Figure 3:
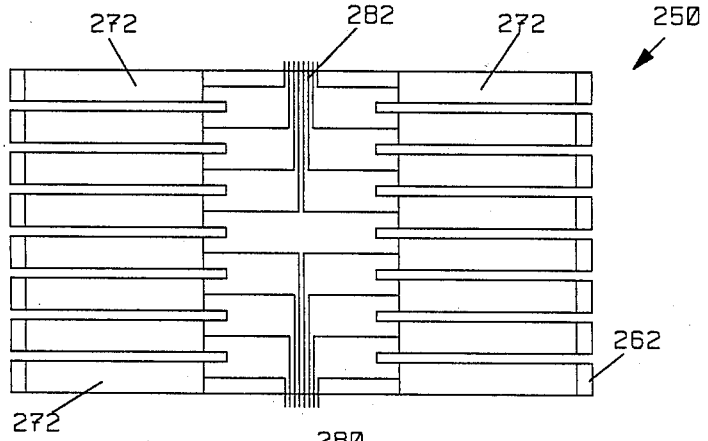
FIGURE 3 (PRIOR ART)
FIG. 3 is a bottom view of the prior art relay module shown in FIG. 2.
Figure 4:
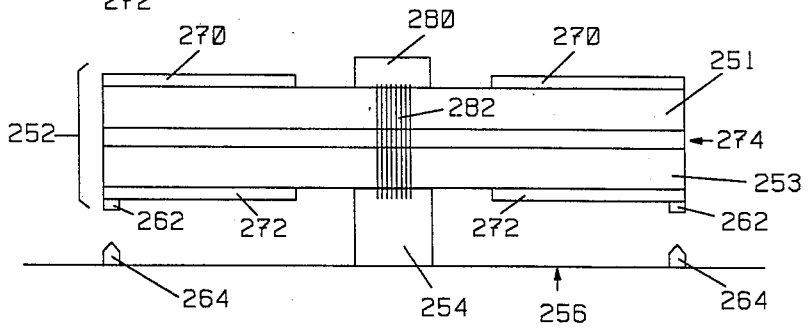
FIGURE 4 (PRIOR ART)
FIG. 4 is an end view of the prior art relay module shown in FIG. 2.

Referring to FIGS. 2–4, the device shown is a relay module 250 constructed in accordance with the above-identified patent. Relay module 250 is constructed from a bimorph structure 252 mounted on a pedestal 254 over a surface 256. FIG. 2 is a top view of bimorph structure 252. FIG. 3 is a bottom view of the bimorph structure 252. FIG. 4 is an end view of relay module 250. The bimorph structure 252 consists of top and bottom piezoelectric plates 251 ad 252, respectively, which are bonded to a continuous center electrode 274.

Relay module 250 includes a plurality of bimorph actuators 260. Each bimorph actuator 260 provides a means for causing a first contact 262 mounted thereon to move relative to a stationary second contact 264 when potentials are applied to electrodes 270 and 272 included on the bimorph actuator 260 in question. The contacts 262 is electrically isolated from the bimorph actuators 260 on which they are mounted. The individual bimorph actuators 260 are constructed by dividing the bimorph structure 252 into a plurality of "fingers" after the two piezoelectric plates 251 and 253 have been bonded to center electrode 274.

In this previously known module 250, each bimorph actuator 260 includes three electrodes, at top electrode 270, a bottom electrode 272, and a center electrode 274. The center electrodes 274 of all of the bimorph actuators are connected together. In this design, the center electrodes 274 are in the form of a continuous metal plate bonded to the top and bottom piezoelectric plates 251 and 253 and substantially coextensive therewith.

Each bimorph actuator 260 is caused to move by applying a potential to either the top electrode 270 or the bottom electrode 272 of the bimorph actuator 260 in question. This design differs from relay 100 shown in FIG. 1 in that an electric field is applied to only one of the piezoelectric plates 251 or 253 at any given time. In this design, the center electrode 274 is held at ground potential and either the top electrode 270 or the bottom electrode 272 is connected a potential different from ground.

The circuitry for applying the potentials to the top and bottom electrodes 270 and 272 is preferably contained in an integrated circuit chip 280 mounted on the top surface of the bimorph structure 252. Connections to electrodes 270 and 272 are provided by depositing conductors 271 on the surfaces of bimorph structure 252 as shown in FIG. 2.

The principle problem with the module 250 is that the relays associated therewith can handle only one size load. Since, as indicated above, the load rating of a relay is directly related to the dimensions of the relay, each of the fingers of the bimorph structure 252 will have the same load rating. What is needed is a relay module in which a variety of loads can be controlled.

In accordance with the present invention, it has been found that a bimorph structure can be provided that will have a plurality of relays that have different load ratings. This is accomplished in a preferred embodiment through the use of a bimorph element that has fingers of varying widths, thus providing, a module that can be utilized in an appliance or the like to control the various loads located therein.

A relay module having different load ratings for the various relays contained therein could be constructed by varying one or more of the dimensions of the bimorph actuators 260 shown in FIGS. 2–4. Of the three possible dimensions, width, thickness, and length, the present invention utilizes actuators of different widths to provide a relay module having a plurality of relays with different load ratings.

In principle, relays having different load ratings could be constructed by varying the thickness or length of the bimorph actuators; however,these alternatives are not satisfactory. Varying the thickness of the bimorph actuators is not practical in a mass produced relay module. Although bimorph actuators of different lengths could be manufactured in an economical manner, this alternative is also unsatisfactory because relays with different length fingers have different maximum displacements. Hence, the maximum voltage that can be placed across the contacts actuated by the bimorph actuator without arcing in the open position would be less for relays having the increased load rating. This constraint is not always consistent with the requirements of the circuitry in which the relays operate. Hence, the present invention utilizes bimorph actuators of different widths to provide relays having different load ratings in a single relay module.

Figure 5:
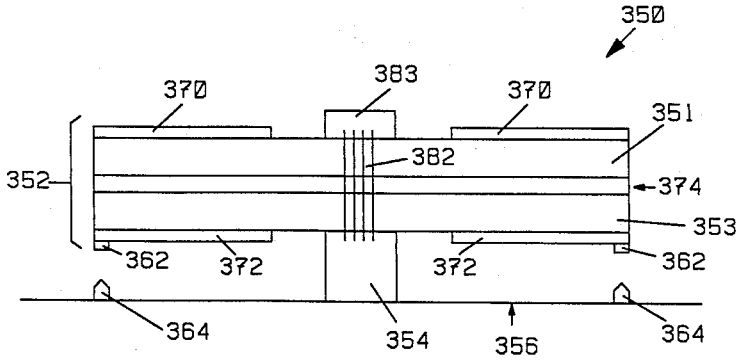
FIG. 5 is an end view of a modular relay switch module in accordance with the present invention.
Figure 6:
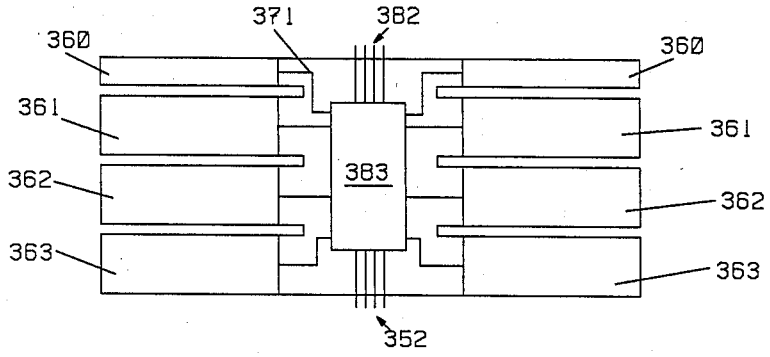
FIG. 6 is a top view of a bimorph element shown in FIG. 5.
Figure 7:
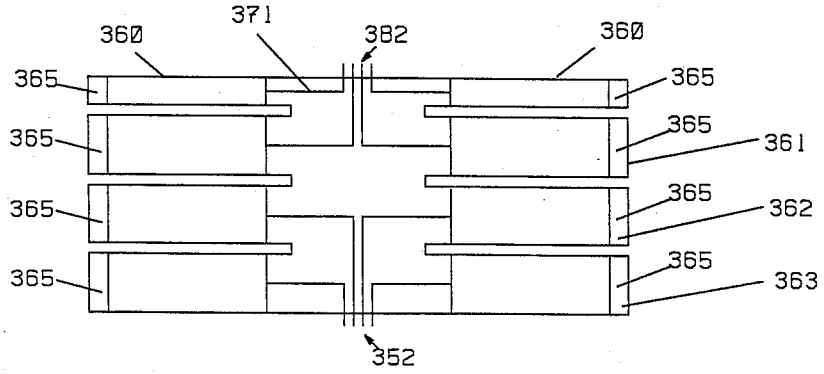
FIG. 7 is a bottom view of the bimorph element shown in FIG. 6.

For a more detailed understanding of the advantages of the present invention, refer to FIGS. 5–7, illustrating a preferred embodiment of a relay module 350 in accordance with the present invention. FIG. 5 is an end view of the rely module 350. Relay module 350 is constructed from a bimorph structure 352 mounted on a pedestal 354 over a surface 356. FIG. 6 is a top view of bimorph structure 352. FIG. 7 is a bottom view of the birmorph structure 352.

Bimorph structure 352 is similar to the bimorph structure 252 of FIGS. 2–4, in that it consists of top and bottom piezoelectric plates, 351 and 353 respectively, which are bonded to a center electrode 374. Relay module 350 includes a plurality of bimorph actuators 360, 361, 362, and 363. In this embodiment, the bimorph actuators 360, 361, 362, and 363 are of different widths. As mentioned eariler, the load rating of each actuator is dependent on its dimensions; therefore each of the bimorph actuators 360-363 will have a different load rating.

Each of the bimorph actuators 360-363 provides a means for causing a contact 365 mounted thereon, but electrically isolated therefrom, to move relative to a stationary contact 364 when potentials are applied to electrodes 370 and 372 included on the bimorph actuators 360, 361, 362 and 363 in question. Each of the bimorph actuators is constructed by dividing the bimorph structure 352 into a plurality of different sized "fingers" after the two piezoelectric plates 351 and 353 have been bonded to the center electrode 374.

In this module 350, as was described above for relay module 250, each of the bimorph actuators 360-363 includes three electrodes, a top electrode 370, a bottom electrode 372, and a center electrode 374. The center electrodes 374 of this embodiment are connected together. The center electrodes 374 are in the form of a continuous metal plate bonded to the top and bottom piezoelectric plates 351 and 353 and substantially coextensive therewith.

In this embodiment, the center electrode 374 is held at ground potential and either top electrode 370 or bottom electrode 372 is connected to a potential different from ground. The circuitry for applying potentials to the top and bottom electrodes 370 and 372 is preferably contained in an integrated circuit chip 380 mounted on the top surface of the bimorph structure 352. Connections to electrodes 370 and 372 are provided by depositing connectors 371 on the surfaces of bimorph structure 352.

The principle advantage of the relay module 350 over the relay module 250 is that the module 350 can be utilized in a device that has a plurality of different sizes of loads. For example, in the embodiment shown in FIGS. 5–7, the width of bimorph actuator 360 is half that of actuators 361 and 362 and is one-third that of actuator 363.

A relay according to the present invention may be efficiently manufactured on a mass-produced basis from a single bimorph structure that can be customized at the time of relay assembly. This aspect of the present invention is illustrated in more detail in FIGS. 8(*a*)–(*d*) which show the preferred method of making a relay according to the present invention.

In this method, a bimorph structure 352 consisting of two piezoelectric plates sandwiching a center electrode is first constructed. This structure may be constucted by bonding the two piezoelectric plates to a center electrode consisting of a brass shim. Prior to bonding the piezoelectric plates to the center electrode, a conductive layer is bonded to the surface of each plate that is to contact the center electrode. The center electrode is then bonded to these surfaces using an electrically conducting bonding agent. The above mentioned conductive layers assure that the electric fields generated by applying voltages between the center electrode and electrodes on the outer surface of the bimorph result in electric fields being generated in the piezoelectric plates and not in the bonding material or air pockets therein. This bimorph structure may then be used to construct a plurality of different relay modules as described below.

Figure 8A:
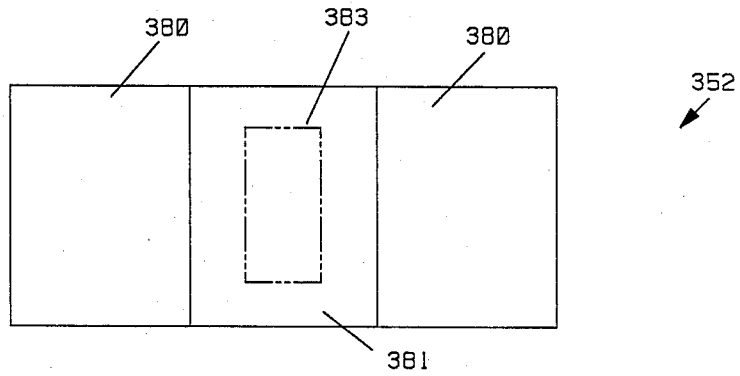
FIGS. 8(*a*)-(*d*) are a view of a bimorph element going through the various phases of formation to form the relay module of the present invention.

The actuator associated with each load is customized by sawing, cutting, or otherwise separating the fingers at the time of relay fabrication. In FIG. 8a the bimorph structure 352 has not yet been modified. Thereafter, the user determines the combination of relays necessary to accommodate the load requirements of the appliance or machine in which it is to operate.

Figure 8B:
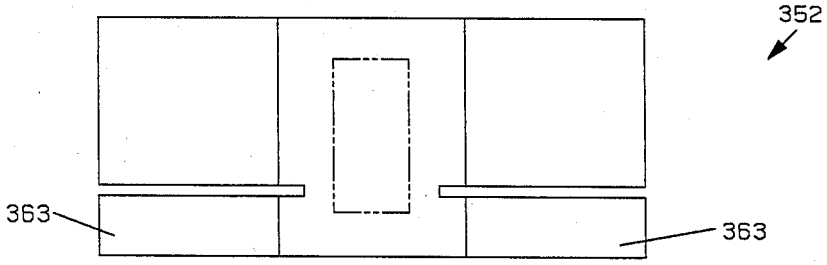
Figure 8C:
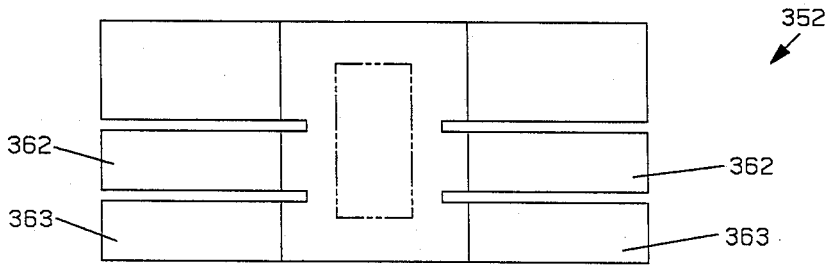
Figure 8D:
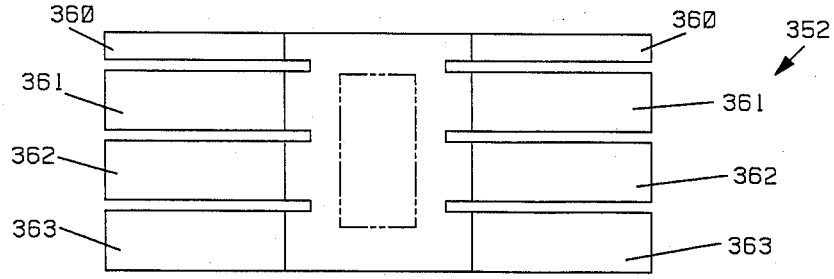

Referring now to FIG. 8*b*, a first cut is made in the bimorph element 352 to provide a first finger 363 on each side of the bimorph. Next, a second cut is made to form a finger 362 on each side of the bimorph element 352. Finally, a third cut is made to form the final two fingers 360 and 361 on each side of the bimorph. In this embodiment, finger 360 is half the width of fingers 361 and 362 and one third the width of finger 363. Hence, the load ratings of fingers 361 through 363 will be varying multiples of the load rating of finger 360.

In addition to defining the widths of the individual fingers, the above described saw cuts may be used to define the electrodes on each finger. Referring again to FIG. 8(*a*), bimorph element 352 preferably includes metal layers 380 bonded to the top and bottom surfaces thereof. An insulating space 381 is provided between metal layers 380 for mounting a driving chip 383 which contains the circuitry used to drive the individual fingers. Each of the cuts used to define a finger, extends through the metal layer which 380. The portion of metal layer 380 which overlies the finger in question then becomes either the top or bottom electrode for that finger. Connections between the top and bottom electrodes created in this manner and the driving chip can then be made by plating conducting lines in region 381 or wires between the electrodes in question and the driving chip.

Thus, it is seen that a bimorph element can be customized to provide a plurality of relays that could control a plurality of different loads. Hence, in a typical situation, the manufacturer of the relay module could have a plurality of bimorph elements 352 in stock that could be tailored for each application. In so doing, the costs of manufacturing are significantly reduced. Accordingly, it has been shown by the above that the relay module in accordance with the present invention represents a significant advance in the art.

It will be apparent to those skilled in the art that the bimorph element which is cut to form the individual bimorph actuators may be constructed by methods other than bonding two piezoelectric plates to a center shim. For example, a bimorph element may be constructed by bonding sandwiching a metal layer between two plates of piezoelectric ceramic while the ceramic is still in the "green" state. The sandwich is then fired to produce a bimorph actuator with a center electrode sandwiched betwee two piezoelectric sheets. This type of construction is well known to those skilled in the ceramic capacitor arts.

The manner in which the individual relay elements are driven may also be varied from that described above and still be within the scope of the present invention. For example, relays in which the top and bottom electrodes are connected together are described in a copending patent application (U.S. Ser. No. 153,158). In this type of relay, all of teh top electrodes are connected to a first potential and all of the bottom electrodes are connected to a second potential. The center electrodes of each of the bimorph actuators are isolated from one another. The bimorph actuator has two stable positions which are specified by coupling the center electrode to either the first or second potential.

Other modifications to the present invention can be made and it would be understood to one of ordinary skill in the art that those modifications would still be within the scope and spirit of the present invention. For Example, the voltage potentials applied to the fingers to drive the individual relays can be a variety of values and still be within the spirit and scope of the present invention. Similarly, one of ordinary skill in the art will recognize that a variety of components can be utilized to drive the relays.

Accordingly, while this invention has been described by means of a specific illustrative embodiment, the principles thereof are capable of a wide range of modification by those of ordinary skill in the art. Hence, the present invention is to be limited only by the scope of the following claims.

What is claimed is:

1. A piezoelectric relay module comprising:

a bimorph element comprising substantially overlying first and second planar sheets of piezoelectric material divided into a plurality of generally coplanar fingers extending from a common spine, at least two of said plurality of fingers having different widths, each of said fingers having a fixed end connected to said common spine and a free end, each of said fingers including an electrical contact on said free end of said finger; and support means for supporting said bimorph element, said support means including a plurality of electrical contacts thereon, each of said electrical contacts of said support means engaging a corresponding electrical contact on said bimorph element when an electric field is applied to said finger.

2. The relay module of claim 1 in which each of said fingers includes means for generating an electric field therein, said electric field causing said free end of said finger to move in a direction substantialy perpendicular to the plane of said finger.

3. The relay module of claim 2 in which said electric field generating means comprises:

a top electrode comprising a conducting layer bonded to the outer surface of one of said planar sheets of said bimorph element including said finger;

a center electrode comprising a conducting layer sandwiched between the inner surface of said first and second planar sheets; and a bottom electrode comprising a conducting layer bonded to the outer surface of the other of said planar sheets of said bimorph element including said finger.

4. The relay module of claim 3 further comprising:

circuit means coupled to said bimorph element for applying selected electrical potentials to at least one of said top, center, and bottom electrodes of each of said fingers; and means for coupling control signals to said circuit means for specifying the potentials to be applied to to each of said fingers on said bimorph element.

5. A piezoelectric relay module comprising:

a bimorph element comprising substantially overlying first and second planar sheets of piezoelectric material divided into a plurality of generally coplanar fingers extending from a common spine; each of said plurality of fingers having widths which differ from the width of at least one of the others of said fingers; each of said fingers having a fixed end connected to said common spine and a free end, each of said fingers also including an electrical contact on said free end of said finger; and support means for supporting said bimorph element, said support means including a plurality of contacts thereon; each of said contacts on said support means engaging a corresponding electrical contact on said bimorph element when an electric field is applied to a corresponding finger; wherein the engaging and disengaging of said corresponding contact on said corresponding finger with said corresponding contact on said support means provides an individual relay within said module and each of said relays within said module has a load rating in accordance with the width of said finger associated with said relay.

6. The relay module of claim 5 in which each of said fingers includes means for generating an electric field therein, said electric field causing said free end of said finger to move in a direction substantially perpendicular to the plane of said finger.

7. The relay module of claim 6 in which said electric field generating means comprises:

a top electrode comprising a conducting layer bonded to the outer surface of one of said planar sheets of said bimorph element including said finger;

a center electrode comprising a conducting layer sandwiched between the inner surface of said first and second planar sheets; and a bottom electrode comprising a conducting layer bonded to the outer surface of the other of said planar sheets of said bimorph element including said finger.

8. The relay module of claim 7 further comprising:

circuit means coupled to said bimorph element for applying selected electrical potentials to at least one of said top, center, and bottom electrodes of each of said fingers; and means for coupling control signals to said circuit means for specifying the potentials to be applied to to each of said fingers on said bimorph element.

9. A method for constructing a relay module comprising a plurality of relays including at least two relays having a different load ratings, said relay comprising a bimorph element having subtantially overlying first and second planar sheets of piezoelectric material divided into a plurality of generally coplanar fingers extending from a common spine, each of said fingers having a fixed end connected to said common spine and a free end which includes an electrical contact mounted thereon, said relay module further comprising means for supporting said bimorph element, said supporting means incuding a plurality of electrical contacts thereon, each of said electrical contacts engaging a corresponding electrical contact on said bimorph element when an electric field is applied to the finger connected to said contact, said method comprising the steps of:

(a) providing a bimorph structure comprising said substantially overlying first and second piezoelectric sheets; and (b) cutting said bimorph structure into a plurality of fingers extending from a common spine thereby converting said bimorph structure into said bimorph element, wherein the widths of said fingers being chosen to provide different load ratings for the relay comprising said finger.

10. The method of claim 9 wherein said bimorph structure further comprises an electrode which is bonded to one surface of one of said first and second piezoelectric sheets and wherein said step of cutting said bimorph structure further comprises cutting said electrode to form isolated electrodes coupled to each said finger.

* * * * *